United States Patent [19]

Hall et al.

[11] Patent Number: 4,542,316

[45] Date of Patent: Sep. 17, 1985

[54] DISCHARGE LAMPS

[75] Inventors: Robert Hall, Bushby; Thomas S. Ainsworth, Queniborough, both of England

[73] Assignee: Thorn EMI plc, London, England

[21] Appl. No.: 384,511

[22] Filed: Jun. 3, 1982

[30] Foreign Application Priority Data

Jun. 6, 1981 [GB] United Kingdom ..... 8117400

[51] Int. Cl.[4] ..... H01J 5/48; H01J 5/50

[52] U.S. Cl. ..... 313/318; 339/14 T; 339/195 L; 339/38; 313/622; 313/623

[58] Field of Search ..... 313/318, 622, 623, 624, 313/625; 339/14 T, 111, 194 R, 195 L, 38, 64 R, 64 M

[56] References Cited

U.S. PATENT DOCUMENTS

| | | | |
|---|---|---|---|
| 3,315,116 | 4/1967 | Beese | 313/623 |
| 3,617,797 | 11/1971 | Meijer et al. | 313/318 |
| 3,675,068 | 7/1972 | Strauss | 313/623 |
| 3,885,149 | 5/1975 | Wolfe et al. | 313/318 |
| 3,960,278 | 6/1976 | Vause | 313/318 |
| 4,103,201 | 7/1978 | Mosby | 339/195 L |
| 4,262,229 | 4/1981 | Bienvenue et al. | 313/318 |
| 4,302,699 | 11/1981 | Keefe et al. | 313/623 |

OTHER PUBLICATIONS

Lamps and Lighting, A manual of lamps and lighting prepared by members of staff of Thorn Lighting Ltd.; editors, Henderson and Marsden, pp. 274–276.

*Primary Examiner*—Saxfield Chatmon

*Attorney, Agent, or Firm*—Fleit, Jacobson, Cohn & Price

[57] ABSTRACT

The invention relates to a single ended discharge lamp, such as a CID or CSI lamp having a bi-pin base. The base is such as to fit a socket suitable for lamps such as tungsten halogen filament lamps for which lower voltages are used and is adapted to make use in such sockets possible. The base or cap member is provided in the usual manner with two pins but at least one of the pins is a dummy pin. At least one extra terminal is disposed to the side of the base whereby electrical connection to one electrode of the lamp is by a flying lead. The other terminal may be the other pin or may be disposed at the other side of the base. In that event both pins may be electrically disconnected from the electrodes and serve only for support or positioning of the lamp.

7 Claims, 8 Drawing Figures

DISCHARGE LAMPS

Figure 1A:
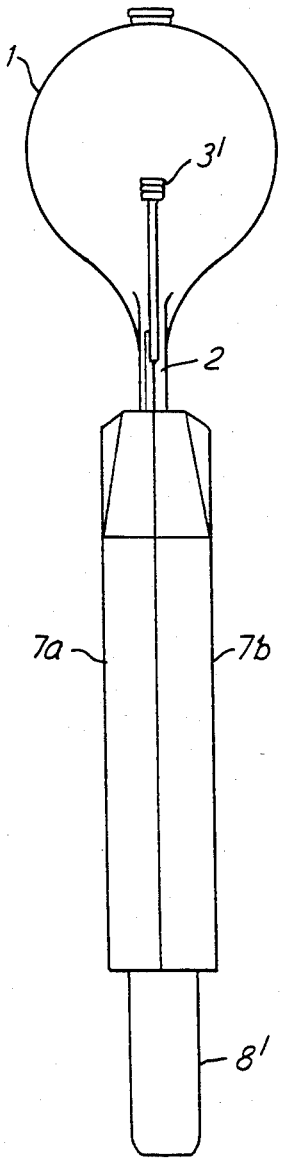

This invention is related to gas discharge lamps and in particular discharge lamps of the single ended type.

In a gas discharge lamp a pair of spaced electrodes are mounted within a sealed transparent or translucent envelope filled with a gas or a vapour which emits light when a discharge takes place between the electrodes. The electrodes are, in general, each mounted on an electrically conductive lead which extends through the envelope. In some lamps, each lead includes a foil section, typically of molybdenum, which is sealed in a flattened portion of the envelope to form a pinch seal.

Such discharge lamps may be of a single ended, construction whereby the electrodes are supported in side-by-side relationship on respective foils in a single, common pinch seal at one end of the envelope.

One known form of single-ended discharge lamp is the "Compact Source Iodide" (CSI) lamp (see for example "Lamps and Lighting" Ed. Henderson and Marsden 2nd Ed. pp 274–276) in which the discharge takes place between electrodes spaced approximately 5 mm to 20 mm apart, and such compact lamps have proved to be particularly suitable for use in a mirror or lens optical system. CSI lamps contain a gas mixture comprising metal iodides, mercury and an inert gas such as argon. In a further development of CSI lamps, known as "Compact Iodide Daylight" (CID) lamps, the composition and pressure of the mixture is adjusted to yield an emission spectrum more closely resembling that of natural daylight. CID lamps usually contain tin and indium iodides together with mercury and argon gas.

Discharge between the electrodes is effected by applying a suitably high voltage pulse across the input leads, from a suitable ignitor. The voltage used is somewhat higher for a CID lamp than has been the practice with CSI lamps and this may require more attention to be paid to electrical insulation in the socket. In some examples insulating material has been introduced between the output leads within the pinch seal or between the connector pins or both.

These lamps are suitable for optical systems such as those of projectors and spot or flood light installations which have been designed to receive the preferred form of lamp. There is, however, a significant requirement for CID and perhaps CSI lamps to replace other forms of lamps, such as tungsten halogen filament lamps, on a retrofit basis in existing optical systems.

It is an object of the invention to provide a construction for single ended discharge lamps, such as CID and CSI lamps allowing the use of existing sockets designed for tungsten halogen filament lamps.

According to the invention there is provided a single-ended discharge lamp, such as a CID and CSI lamp, having two discharge electrodes mounted in a discharge envelope and electrically connected by respective leads to respective terminals in a cap member supporting the envelope and having two pin members disposed in side-by-side relationship in the base of the cap member, wherein at least one of the pin members is a dummy pin and at least one of the said terminals is disposed at one side of the cap member.

The other terminal may be the other pin member or may be disposed at the other side of the cap member whereupon both of the pin members are electrically disconnected from the electrodes and serve to support or position the lamp or both.

If the other terminal is the other pin member, the dummy pin may be electrically connected thereto allowing the lamp to be fitted without regard to orientation.

Insulation is preferably provided within the cap member between the two terminals and between the terminals and the dummy pin or pins.

Typically CID and CSI lamps use a standard G38 bi-pin base (in which the centre lines of the pins are spaced at approximately 38 mm) and this base has been used for tungsten halogen filament lamps. The CID and CSI lamps will therefore fit into the tungsten halogen lamps sockets and it might seem that they might simply be used as a replacement, with appropriate changes to the electrical circuit. This is not, however, the case. In equipment intended to receive tungsten halogen lamps the sockets have generally been designed in the knowledge that they will only need to withstand the relatively low running voltages of such filament lamps. However if CDI or CSI lamps are used it will be necessary for the sockets to withstand the high voltages required to ignite such discharge lamps. The problem is particularly serious when hot restrike lamps are used.

Of course sockets designed for discharge lamps could be substituted. However this does to some extent negate the value of the retrofit and also in some cases limited space within the existing equipment in which discharge lamps may be installed may preclude the use of a different socket suitable for such lamps.

This invention provides a modified discharge lamp which may be used in existing tungsten halogen lamp sockets, with approriate changes to the electrical connections to the sockets.

Figure 1B:
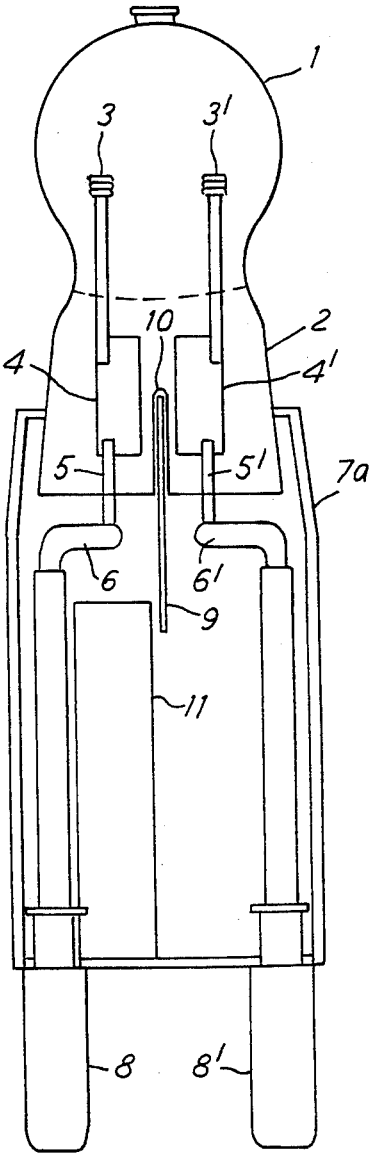
FIG. 1b PRIOR ART

In order that the invention may be clearly understood and readily carried into effect it will now be described by way of example with reference to the accompanying drawings, of which:

FIG. 1*a* and 1*b* show end and side elevations respectively of a known single-ended CID discharge lamp.

Figure 2B:
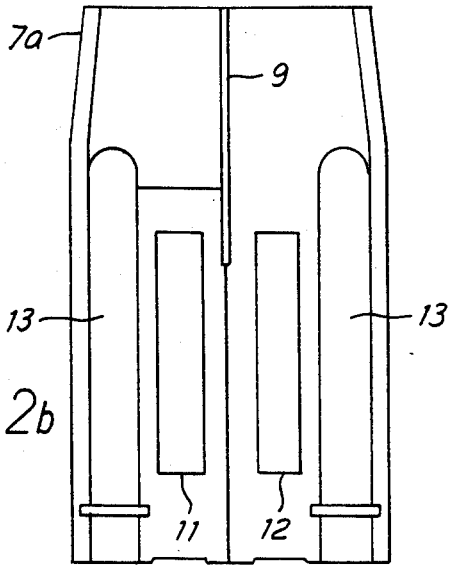
Figure 2C:
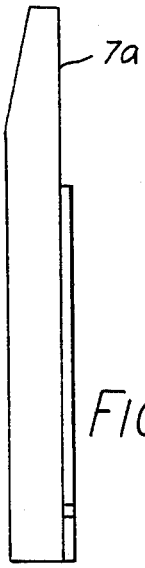
Figure 2A:
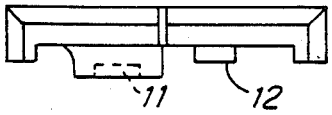

FIG. 2*a*, 2*b* and 2*c* show plan and side and end elevations respectively of one part of a two part ceramic cap member for the lamp of FIG. 1.

Figure 4:
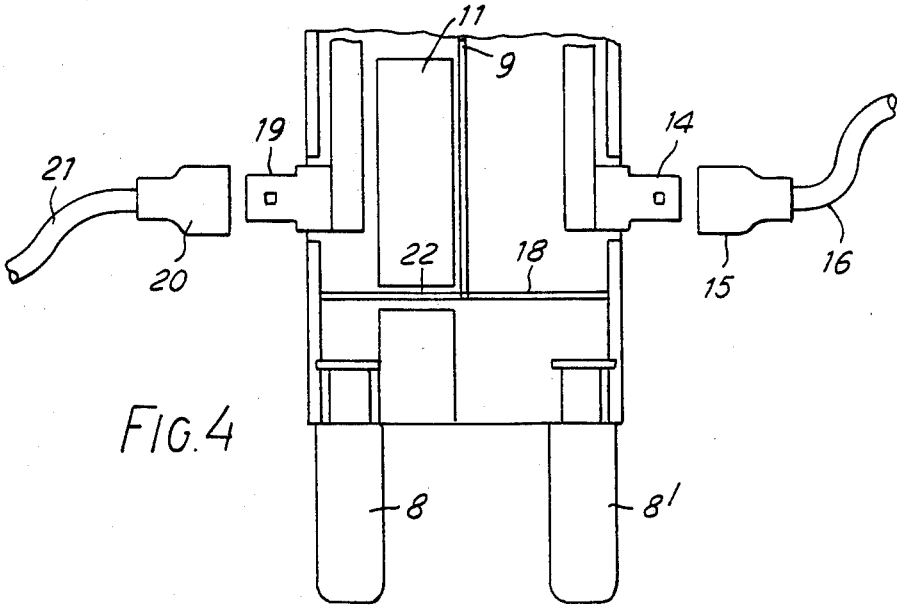
Figure 3A:
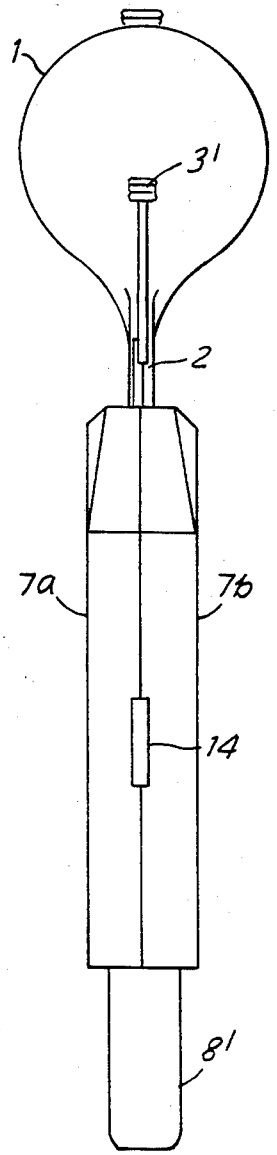
Figure 3B:
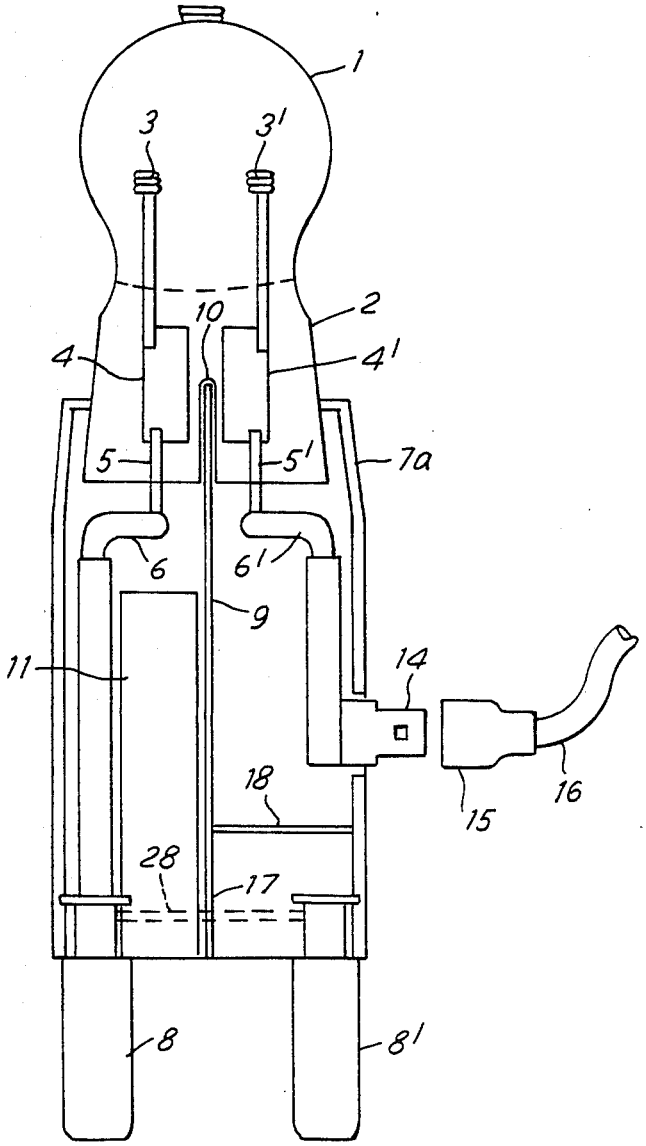

FIGS. 3*a* and 3*b* show end and side elevations respectively of a discharge lamp in accordance with this invention, and FIG. 4 shows a modified part of the lamp of FIG. 3 having two dummy pins.

The discharge lamp shown in end and side elevation in FIG. 1*a* and 1*b* respectively is a known form of discharge lamp which may be a CID lamp. The lamp comprises an envelope 1 made of a suitable material such as quartz and being a generally rounded bulb with a pinch seal 2 at one end. Mounted in side-by-side relationship in the pinch seal 2 to intrude into the bulb are a pair of spaced, overwound tungsten electrodes 3 and 3' which may be of well known construction. The electrodes are connected to molybdenum foils 4 and 4' which allow a gas tight seal in pinch seal 2. The foils are in turn connected by leads 5 and 5' to respective connectors 6 and 6'.

Connectors 6 and 6' are supported by a cap 7 which is also fixed around and supporting the envelope 1 at pinch seal 2. The connectors 6 and 6' terminate in respective pins 8 and 8' in side-by-side relationship this being a standard G38 bi-pin base. The pins fit into a mating socket (not shown) from which electrical supply is provided and which for a G38 base may be a socket designed for a tungsten halogen filament lamp. The pins 8 and 8' and socket also serve to position the lamp accurately for example in relation to a mirror or lens optical system.

The Cap 7 is provided in two, in this example, identical parts 7*a* and 7*b*, both of which are shown in FIG. 1*a* but one of which is removed in FIG. 1*b* to show the internal structure. The cap 7 is made of a high alumina ceramic, for example that know as "REGALOX" and the two parts are fixed together with a suitable cement for the material used.

Included within the cap 7 is a strip of insulating material 9, in this example mica, placed between leads 5 and 5' which are relatively closely spaced for the voltage used. A slot 10, cut into or formed in the pinch seal 2 facilitates this.

The two parts of cap 7 are formed with complimentary steps, of which 11 is a recessed part to facilitate mating of them. FIGS. 2*a*, 2*b* and 2*c* show respectively plan, side and end elevations of one part 7*a* of the two identical parts of cap 7. Visible are the recessed part 11 and a complimentary raised part 12. Openings are provded at 13 for the connectors 6 and pins 8.

Since provision is provided within cap 7 for insulation between the leads, the problem of arcing on application of the higher voltages required for CID lamps arises mainly between the connections in the socket to pins 8 and 8'.

In a preferred form of a lamp according to the invention, shown in end and side elevation in FIGS. 3*a* and 3*b* respectively, the lamp is a CID lamp, although clearly the fill may be varied to suit the applications of the lamp and future developments. The invention is thus suitable for any single ended discharge lamp for which the arcing problems are similar.

In FIG. 3 those parts also found in FIGS. 1 and 2 are identified with the same reference numerals and the views are the same as those of FIG. 1. In particular the connection from electrode 3 through to pin 8 is in general the same as in the CID lamp of FIG. 1 and is in this example identical to it. However lead 6' from electrode 3' is not connected to pin 8', which thus becomes a "dummy" pin providing support and positioning in the existing tungsten halogen lamp socket but not for electrical connection. Instead the lead 6' is connected to a terminal 14, in the side of cap 7, to which electrical supply is provided by a female connector 15 and a "flying" lead 16.

The insulating material 9 is in this example shown extended at 17 and further insulation 18 is shown provided between dummy pin 8' and connector 14. It is desired that the dummy pin 8' is sufficiently insulated from at least the connector 14 and perhaps the pin 8 either by insulating material as illustrated or by an air gap. If desired, the dummy pin 8 may be electrically connected to pin 8 as indicated at 28. In that case if one of the socket connections is used as a neutral line the lamp may be inserted without regard to orientation. The same effect may be achieved by connecting the terminals together in the socket.

The use of a flying lead such as 16 allows additional flexibility when installing a lamp on a retrofit basis.

This latter position may be further eased by a variation shown in FIG. 4 in which pin 8 is also a dummy pin and connection to electrode 3 is by connector 6 to a connector 19 with a respective female connector 20 and flying lead 21. The internal insulation may be further extended at 21 between pin 8 and connector 19. In this example pins 8 and 8' serve in the tungsten halogen lamp socket exclusively for positioning and support with all electrical supply being by the expedient of the flying leads.

Although the invention has been described in terms of adaptation of CID or CSI lamps for use in sockets designed for tungsten halogen filament lamps, it is applicable to any similar use of high voltage discharge lamps in sockets not considered suitable for the voltages required.

We are aware of an arrangement described in British Patent No. 1211179 for a single ended filament lamp in which electrical connections are taken from pinch seal foils to the side of the pinch seal. In that case the pins protruding from the base of the pinch seal are intended to be used primarily for support of the lamp. They are, however, still connected to the pinch seal foils and in electrical connection with the electrodes and with the true electrical inputs. That lamp, being a filament lamp, does not require a starting pulse and the problems faced with it are entirely different from those of discharge lamps such as CID lamps. The arrangement disclosed in said patent would not solve the present problem at least because the end pins, being still in electrical connection, would still be capable of arcing at high voltages.

What we claim is:

1. A single ended discharge lamp, such as a CID or CIS lamp, having two discharge electrodes mounted in a discharge enevelope and electrically connected by respective leads to respective terminals in a cap member of insulating material supporting the envelope and having two pin members disposed in side-by-side relationship protruding from the base of the cap member, wherein at least one of the pin members is a dummy pin and at least one of said terminals is disposed at one side of the cap member, said lamp further comprising insulation in said cap member provided between the two terminals and between at least one of the terminals and the dummy pin or pins.

2. A lamp according to claim 1 in which the other of the pin members is connected to one of the discharge electrodes to form the other of said terminals.

3. A lamp according to claim 2 in which the dummy pin is electrically connected to the said other pin member to allow the lamp to be inserted into an appropriate socket without regard to orientation.

4. A lamp according to claim 1 in which the other of said terminals is disposed at another side of the cap member, spaced from the first said terminal.

5. A lamp according to claim 4 in which both pin members are dummy pins electrically insulated from both of said discharge electrodes and serve to support the lamp or position it or both.

6. A lamp according to claim 1 in which the cap member and pin member are of the dimensions and configuration of a G38 bi-pin base to an extent sufficient to fit a socket for such a base.

7. A lamp according to claim 1 in which the other pin member is a dummy pin and the other electrical terminal is disposed at the opposite side of the cap member to the first mentioned terminal with a flying lead provided for electrical connection thereof.

* * * * *